US006619996B2

(12) United States Patent
Hara et al.

(10) Patent No.: US 6,619,996 B2
(45) Date of Patent: Sep. 16, 2003

(54) WATERPROOF CONNECTOR

(75) Inventors: Terufumi Hara, Shizuoka-ken (JP); Takao Murakami, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 35 days.

(21) Appl. No.: 09/940,654

(22) Filed: Aug. 29, 2001

(65) Prior Publication Data

US 2002/0031934 A1 Mar. 14, 2002

(30) Foreign Application Priority Data

Sep. 11, 2000 (JP) ..... P 2000-275046

(51) Int. Cl.[7] ..... H01R 13/502
(52) U.S. Cl. ..... 439/701; 439/275
(58) Field of Search ..... 439/274, 275, 439/701, 717, 936

(56) References Cited

U.S. PATENT DOCUMENTS 5,954,533 A * 9/1999 Hatagishi et al. ..... 439/397
6,375,517 B1 * 4/2002 Okabe et al. ..... 439/701
6,464,543 B2 * 10/2002 Suzuki ..... 439/736

FOREIGN PATENT DOCUMENTS

| | | |
|---|---|---|
| DE | 43 41 958 A1 | 6/1995 |
| DE | 199 50 129 A1 | 4/2001 |
| EP | 1 089 390 A2 | 4/2001 |
| JP | 6-5150 | 1/1994 |
| JP | 10-255869 | 9/1998 |

OTHER PUBLICATIONS

Search Report/German Patent Office, Jul. 17, 2002.

* cited by examiner

*Primary Examiner*—Khiem Nguyen
(74) *Attorney, Agent, or Firm*—Finnegan, Henderson, Farabow, Garrett & Dunner, L.L.P.

(57) ABSTRACT

A waterproof connector has an inner housing 11 for holding insulation displacement terminals 13 connected to wires W and an outer housing 12 formed with an inner housing accommodation space 12A for receiving the inner housing 11 in the longitudinal direction. The outer housing 12 receiving the inner housing 11 is formed in its rear portion 12F with a waterproofing part 17 made of hot-melt material. This facilitates production of a waterproof connector with a smaller number of parts.

4 Claims, 8 Drawing Sheets

WATERPROOF CONNECTOR

BACKGROUND OF THE INVENTION

1. Field of the Invention

This invention relates to a waterproof connector.

2. Description of the Related Art

As a conventional connector for connecting wire harnesses in automobiles, a connector disclosed in Japanese Patent Laid-Open Publication No. Hei-10-255869 is known. This connector consists of a connector housing, insulation displacement terminals arranged in parallel and held in the connector housing, and a cover. A wire is fitted into each of the terminals and held for connection. The cover is mounted on the housing so as to cover the terminals connected to the wires. The cover has a plurality of wire hold-down parts projecting downward from the rear end of the body thereof. The cover is mounted on the housing to cover the upper portion of the terminals with the body and to hold the wires down with the wire hold-down parts, preventing them from slipping off.

As a connector with waterproofing structure, a waterproof connector disclosed in Japanese Utility Model Laid-Open Publication No. Hei-6-5150 is known. This waterproof connector has a connector body formed with a plurality of terminal housing chambers and a hood surrounding the connector body with an annular accommodating space interposed therebetween. A seal ring is fitted into the annular accommodating space between the rear part of the connector body and the rear part of the hood, to secure waterproofing in the rear portion of the connector body.

SUMMARY OF THE INVENTION

The former connector enables introduction of automation in assemblage by virtue of the structure, in which high waterproofing is not obtained, however.

In the latter connector, the seal ling has a predetermined shape, so that it is impossible to integrate a plurality of connector bodies with each other. For example, in a case where wires are branched from the trunk of a wire harness fitted to the waterproof connector, another waterproof connector of the same structure is used for the branched wires to be fitted thereto in addition to the connector for the trunk of the wire harness. Thus different waterproof connectors should be used for the trunk wire harness and the branched wires, respectively, making the connecting operation of the wire harness complicated.

It is therefore a principal object of this invention to provide a waterproof connector which can be produced easily with a smaller number of parts and has high waterproofing effect.

It is another object of this invention to provide a waterproof connector in which a plurality of connecters can be integrated with each other.

According to a first aspect of this invention, there is provided a waterproof connector including: an inner housing for holding a terminal connected to a wire; and an outer housing having an inner wall defining an accommodating space for the inner housing to be inserted thereinto in the longitudinal direction; wherein, the outer housing with the inner housing inserted thereinto has a rear portion formed with a waterproofing part made of hot-melt material.

In this aspect, since the inner housing is inserted into the accommodation space of the outer housing, and the hot-melt material forms the waterproofing part in the rear portion of the outer housing, water invasion from the rear end of the outer housing is reliably prevented. Further, since the hot-melt material is used for filling the rear part of the outer housing, the number of parts is made smaller and automation of the mounting operation is facilitated.

It is preferred that the rear portion of the outer housing be formed with a recess filled with resin for forming the waterproofing part.

Thus the injection of the hot-melt material into the recess to be filled with resin facilitates the formation of the waterproofing part.

It is preferred that a plurality of inner housings be integrated with each other, being inserted in the outer housing.

Thus the number of wires can be increased at will. Further, the integration of the plurality of inner housings allows the terminals within the inner housing and a mating connector to be connected by single operation.

It is preferred that the inner housings each have a side formed with one of an engagement part and a mating engagement part for connection.

Thus the operation of inserting the plurality of inner housings into the outer housing is facilitated.

It is preferred that the inner housings each have a terminal connected to a wire of a sub harness branched from a wire harness.

Thus even when the inner housings are connected to different sub harnesses, the integration of the inner housings enables connecting operation using a single waterproof connector without requiring their respective connectors, providing simplified operation.

It is preferred that the inner housing be formed with a flange contacting the rear end of the inner wall of the outer housing to close the accommodation space.

Thus since the flange cntacts the rear of the outer housing to close the accommodation space, the hot-melt material being injected is prevented from entering the front portion of the accommodating space. This eliminates the need for controlling the amount of flow of the hot-melt material in injection operation.

It is preferred that the inner housing has a rear portion filled with high-viscosity gel, the rear portion where the terminal is disposed and held, and then the waterproofing part is formed on the gel.

Thus since the flange contacts the rear of the outer housing to close the accommodation space, the hot-melt material being injected is prevented from entering the front portion of the accommodating space. This eliminates the need for controlling the amount of flow of the hot-melt material in injection operation.

BRIEF DESCRIPTION OF THE ACCOMPANYING DRAWINGS

The above and further objects and novel features of this invention will more fully appear from the following detailed description when the same is read in conjunction with the accompanying drawings, in which.

DETAILED DESCRIPTION OF THE PREFERRED EMBODIMENTS

With reference to the accompanying drawings, preferred embodiments of this invention will now be described.

First Embodiment

Figure 1:
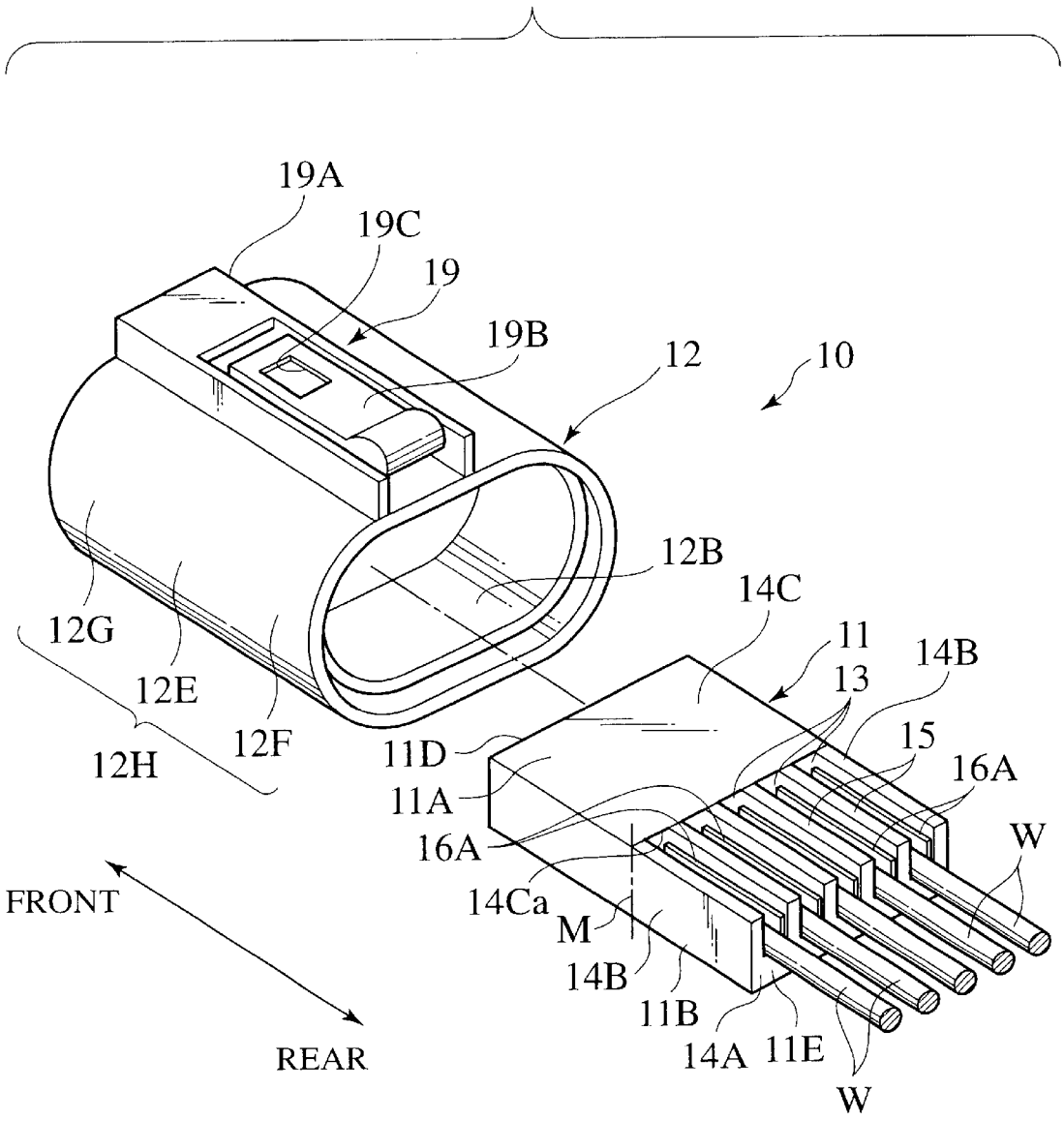
FIG. 1 is an exploded perspective view of a waterproof connector according to a first embodiment of this invention.
Figure 2:
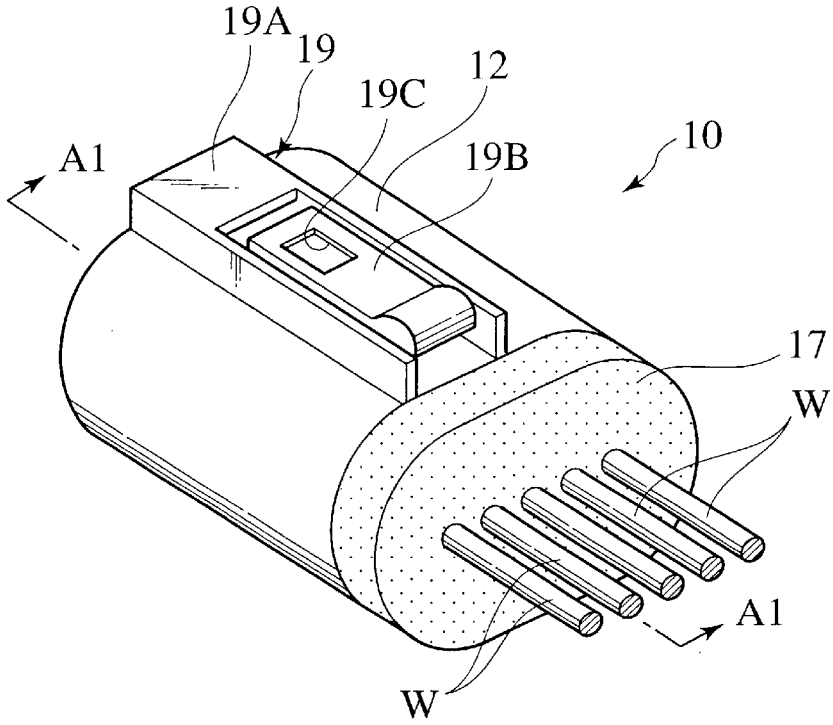
FIG. 2 is a perspective view of the waterproof connector according to the first embodiment.
Figure 3:
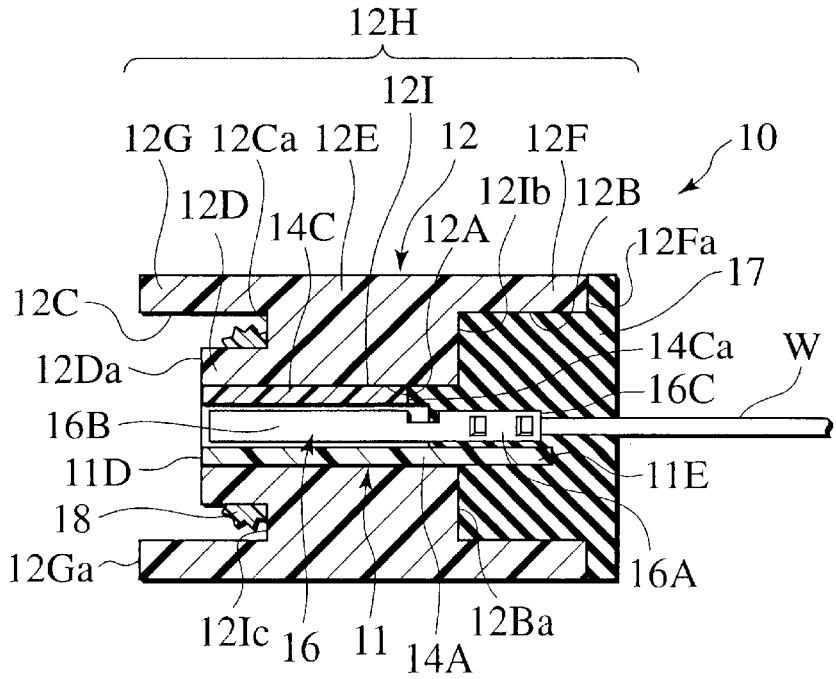
FIG. 3 is a sectional view taken along line A1—A1 in FIG. 2.

A waterproof connector 10 according to a first embodiment includes an inner housing 11 in a flat rectangular shape and an outer housing 12 for receiving the inner housing 11 as shown in FIGS. 1 and 3, and a waterproofing part 17 made of resin as shown in FIGS. 2 and 3.

The inner housing 11 has, as shown in FIG. 1, a plurality of terminal housing channels 13 arranged in parallel, extending in the longitudinal direction. In the front portion 11A of the inner housing 11, the channels 13 extend below a top wall 14C. In the rear portion 11B of the inner housing 11, provided are a plurality of partitions 15 for separating the adjacent channels 13 from each other. In each of the channels 13, an insulation displacement terminal 16, for example, is disposed and held.

More specifically, the inner housing 11 has a bottom wall 14A, and a pair of side walls 14B extending from the opposite sides of the bottom wall 14A, facing each other. The bottom wall 14A and the side walls 14B define a space for terminals. The partitions 15 of the housing 11 extend along the side walls 14B from the front end 11D to the rear end 11E. The partitions 15 define the terminal housing channels 13 therebetween. The channels 13 are covered with the top wall 14C from the end 11D to the longitudinally middle point M. The end 14Ca of the top wall 14C corresponds to the middle point M.

Now the configuration of the terminal 16 is briefly described. The terminal 16 has a pair of opposed insulation displacement plates 16A bent upright on opposite sides. Each of the plates 16A is formed at its rear part with an insulation displacement blade bent inwardly. As shown in FIGS. 1 and 3, an electric wire W is press-fitted between the plates 14A for connection between the core wire and the blades. The terminal 16 is also formed at its front part a hollow rectangular connecting part 16B. Fitted into the connecting part 16B is a terminal of a mating connector not shown for connection.

The outer housing 12 has, as shown in FIG. 1, a larger width dimension than the inner housing 11 and a larger thickness dimension than the inner housing 11. The outer housing 12 is formed with an inner housing accommodation space 12A extending therethrough in the longitudinal direction. The rear part of the outer housing 12 has a recess 12B to be filled with resin. The space within the recess 12B communicates with the space 12A therein. The front part of the outer housing 12 has a recess 12C for receiving a housing of a mating connector not shown. A tubular part 12D including the inner housing accommodation space 12A is configured to project by a predetermined distance from the bottom wall 12Ca of the recess 12C. A packing 18 is wound around the periphery of the tubular part 12D.

The outer housing 12 in a elliptic sectional shape has an outer wall 12H extending longitudinally in a tubular shape.

The outer housing 12 has at its central part an internal wall 12I defining the space 12A therein. The rear part 12F of the outer wall 12H, together with a front end 12Ib of the internal wall 12I, defines the recess 12B. The rear part 12F extends beyond the rear end 11E of the inner housing 11 and the top end 16C of the terminal 16. A front part 12G of the outer wall, together with a front end 12Ic of the internal wall 12I, defines the recess 12C. The front part 12G faces the tubular part 12D and extends beyond the top end 12Da. The top end 12Da and the rear end 11D of the inner housing 11 are flush with each other.

The outer housing 12 is provided at its top with an engagement part 19 to engage with a mating connector not shown. The engagement part 19 has, as shown in FIGS. 1 and 2, a tube 19A for receiving an engagement part of the mating connector not shown to be inserted thereinto, a resilient engagement piece 19B, and an engagement opening 19C as a hollow in the engagement piece 19B. The engagement part of the mating connector inserted into the tube 19A engages with the engagement opening 19C.

In the waterproof connector 10 of this embodiment, the terminals 16 are fitted to the inner housing 11 as shown in FIG. 1. Wires W are connected to the terminals 16. The inner housing 11 is inserted into the space 12A of the outer housing 12. The front end 14Ca of the top wall 14C is set back from the rear end 12Ib of the inner wall 12I to the inside of the space 12A. The front end 11E of the inner housing 11 and the rear ends of the terminals, that is, the insulation displacement plates 16A, protrude from the bottom face 12Ba or the rear end 12Ib of the internal wall 12I into the recess 12B. As shown in FIG. 3, the recess 12B of the outer housing 12 with the inner housing 11 inserted thereinto is injected with hot-melt material to form the waterproofing part 17. As the hot-melt material, thermoplastic polyamide resin is used, for example. This resin is nontoxic and has an elasticity and such properties as being solidified by cooling for some twenty seconds. Appropriate viscosity of the hot-melt material for use ranges, for example, from 2800 to 3800 (mPa/S). Appropriate temperature for the connector for use ranges from about −40° C. to 100° C.

Specifically, the resin melted flows into the space 12B. The resin partly flows into the space 12A to fill between the wires W, the terminals 16 and the internal wall 12I. The resin also fills the space 12B, that is, between the rear part 12F of the outer wall, the terminals 16 and the wires W for water-tight sealing. The resin fills the recess 12B and reaches the top end 12Fa of the rear part 12F.

In the first embodiment of such a structure, hot-melt material is used for sealing the rear part 12F, so that the waterproofing connector 10 can be made of two parts, the inner housing 11 and the outer housing 12, thereby reducing the number of parts to be used. Further, in the first embodiment, the operation of inserting the inner housing 11 into the outer housing 12 and the operation of integrating them with each other, using hot-melt material, can be automated, which increases productivity.

Modification of First Embodiment

Figure 4:
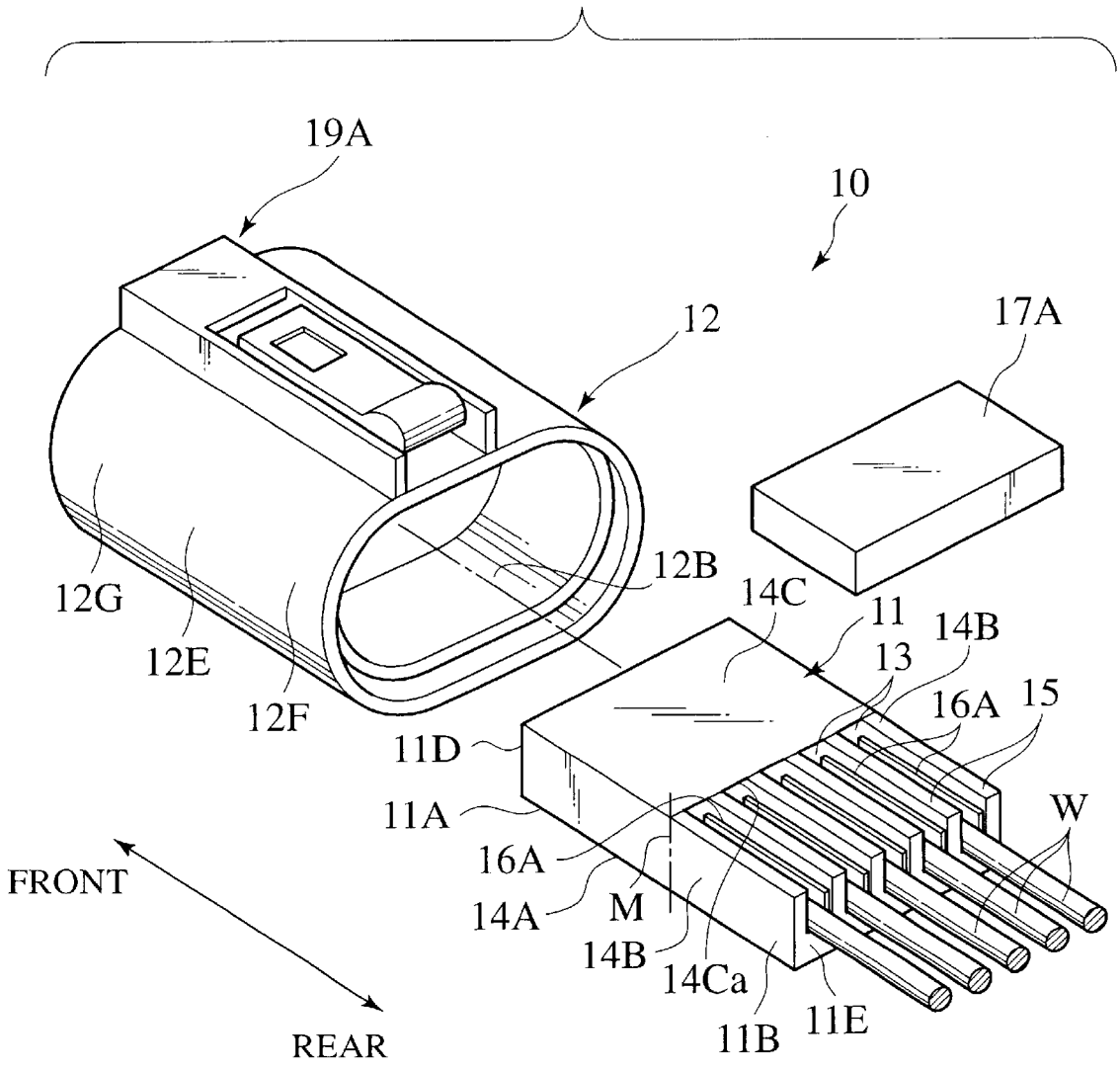
FIG. 4 is an exploded perspective view of a modification of the waterproof connector according to the first embodiment.
Figure 5:
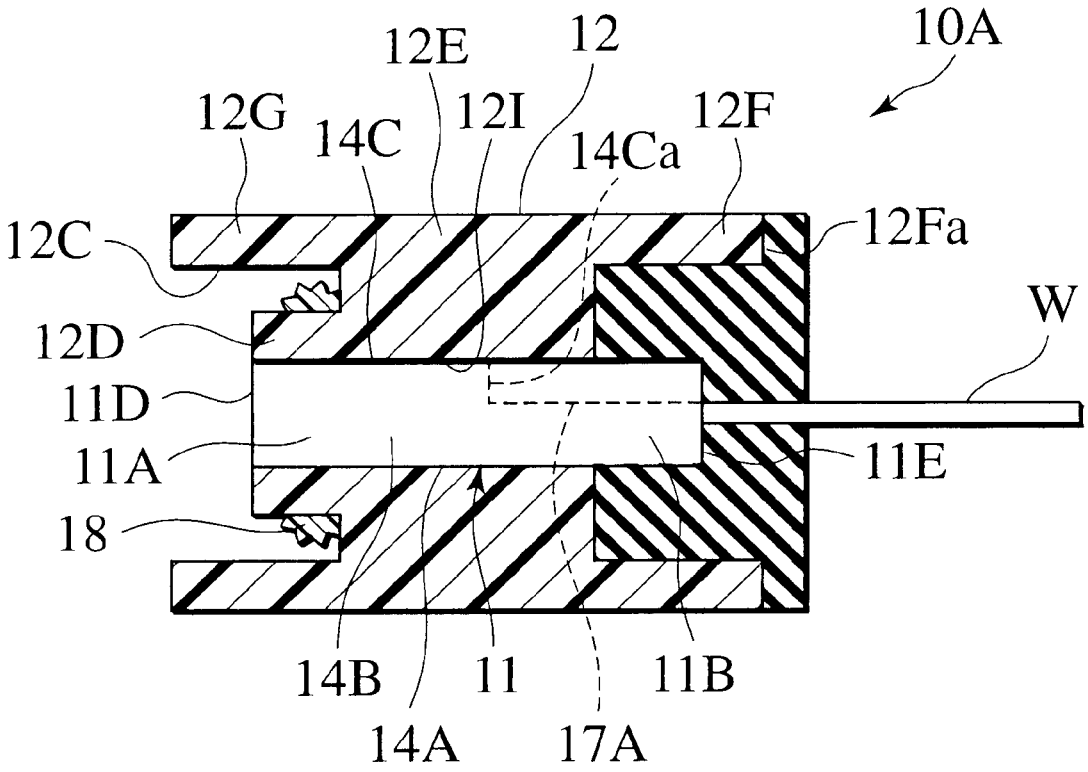
FIG. 5 is a sectional view of the modification of the first embodiment.

In a modification of the first embodiment, a predetermined amount of high-viscosity gel 17A as shown in FIG. 4 is used for filling exposed channels 13. The gel 17A fills between terminals 16, wires W and partitions 15 for watertight sealing. Thereafter, as in the first embodiment, a waterproofing part 17 is formed. As the material for the gel 17A, used is silicon gel which is speedily solidified by cooling (requiring for about twenty seconds), non-toxic, adhesive, refractory, and has good electrical properties and good drug tolerance. The use of the high-viscosity gel 17A by a predetermined amount prevents the hot-melt material from excessively entering gaps in the terminals 16. FIG. 5 shows a waterproofing connector 10A in this modification.

Second Embodiment

Figure 6:
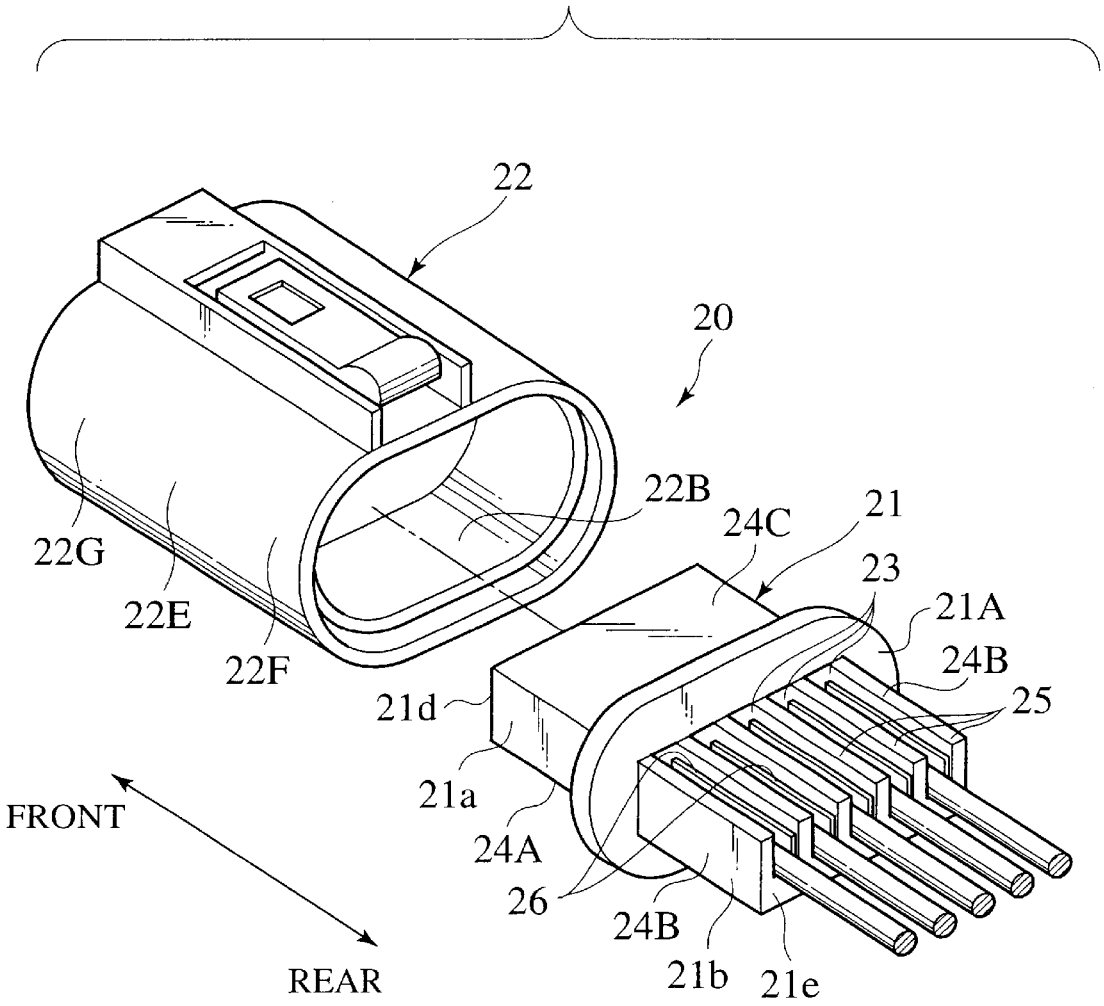
FIG. 6 is an exploded perspective view of a waterproof connector according to a second embodiment of this invention.
Figure 7:
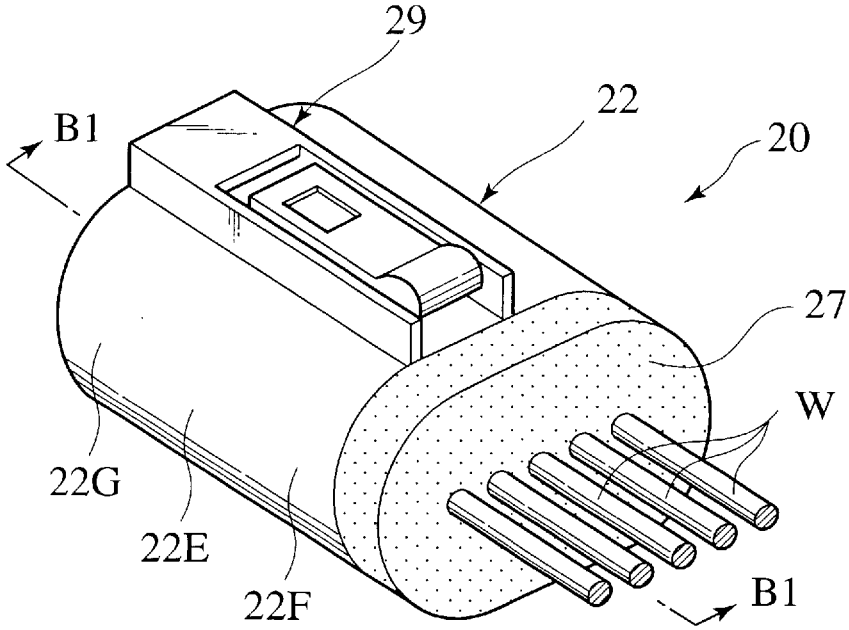
FIG. 7 is a perspective view of the waterproof connector according to the second embodiment.
Figure 8:
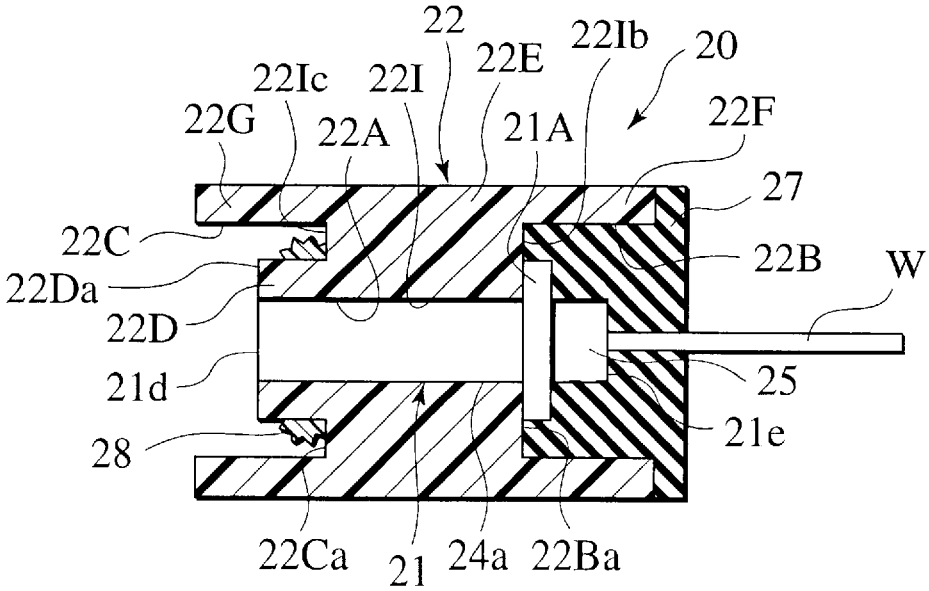
FIG. 8 is a sectional view taken along line B1—B1 in FIG. 7.

A waterproofing connector 20 according to a second embodiment of this invention includes an inner housing 21 and an outer housing 22 for holding the inner housing 21 as shown in FIGS. 6 and 8, and a waterproofing part 27 as shown in FIGS. 7 and 8.

The inner housing 21 is formed, as shown in FIG. 6, with a plurality of terminal housing channels 23 positioned in parallel, extending in the longitudinal direction. In the front portion of the inner housing 21, the channels 23 extend below a top wall 24C. The inner housing 21 is formed with a flange 21A around the rear end of the front part 21*a*, that is, at the boundary between the front part 21*a* and the rear part 21*b*.

The rear part 21B of the inner housing 21 is formed with a plurality of partitions 25 for separating the channels 23 from each other. An insulation displacement terminal 26, for example, is housed in each channel 23.

The outer housing 22 has a width larger than that of the inner housing 21 and a thickness larger than that of the inner housing 21, as in the first embodiment. The outer housing 22 also has an inner housing accommodation space 22A extending therethrough longitudinally. The rear part 22F of the outer housing 22 is formed with a recess 22B to be filled with resin. The space within the recess 22B communicates with the space 22A. The front part 22G of the outer housing 22 is formed with a recess 22C for receiving a housing of a mating connector not shown to be fitted thereinto. A tubular part 22D including the inner housing accommodation space 22A projects from the bottom 22Ca of the recess 22C by a predetermined distance. A packing 28 is wound around the periphery of the tubular part 22D.

The outer housing 22 is provided at its top with an engagement part 29 as in the first embodiment.

In the waterproof connector 20 of this second embodiment, a plurality of terminals 26 are fitted into the inner housing 21 as shown in FIG. 6. A wire is connected to each terminal 26. The inner housing 21 is inserted into the space 22A of the outer housing 22. As shown in FIG. 8, the recess 22B of the outer housing 22 with the inner housing 21 inserted thereinto is injected with hot-melt material to form a waterproofing part 27. As the hot-melt material, thermoplastic polyamide, for example, is used as in the first embodiment.

In the second embodiment, the flange 21A formed around the inner housing 21 is brought into tight contact with the bottom 22Ba of the recess 22B in the rear part of the outer housing 22. This prevents the injected hot-melt material from flowing forward beyond the flange 21A. Thus the second embodiment eliminates the need for controlling the amount of flow of the injected hot-melt material.

Third Embodiment

Figure 9:
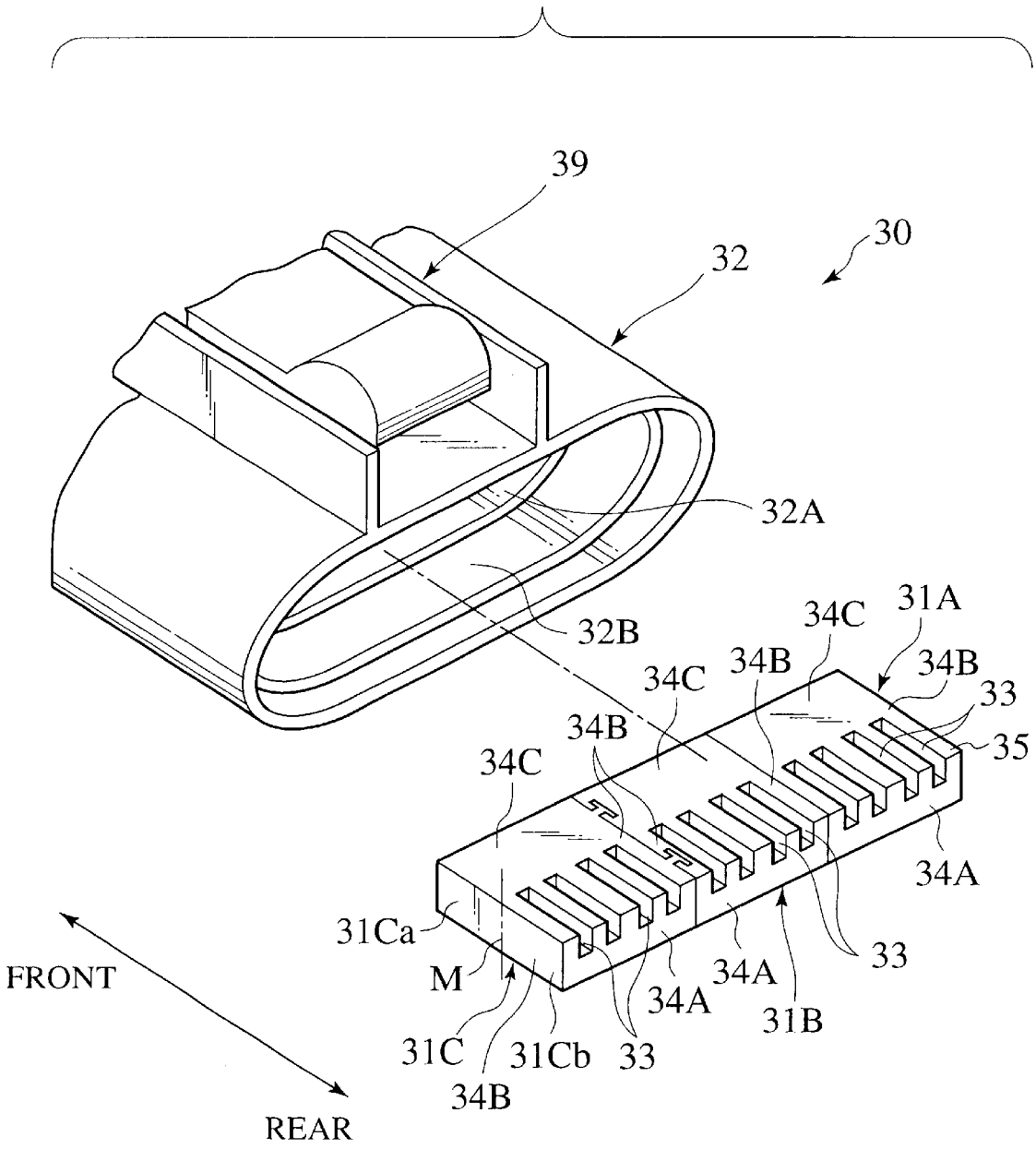
FIG. 9 is an exploded perspective view of a waterproof connector according to a third embodiment of this invention.
Figure 10:
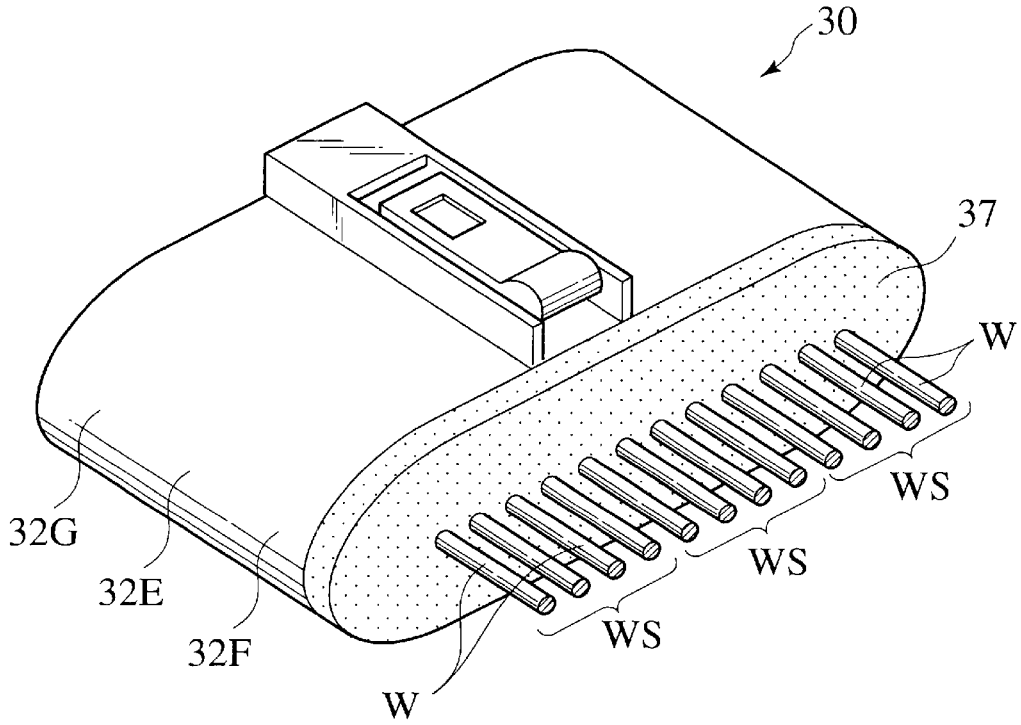
FIG. 10 is a perspective view of the waterproof connector according to the third embodiment.
Figure 11:
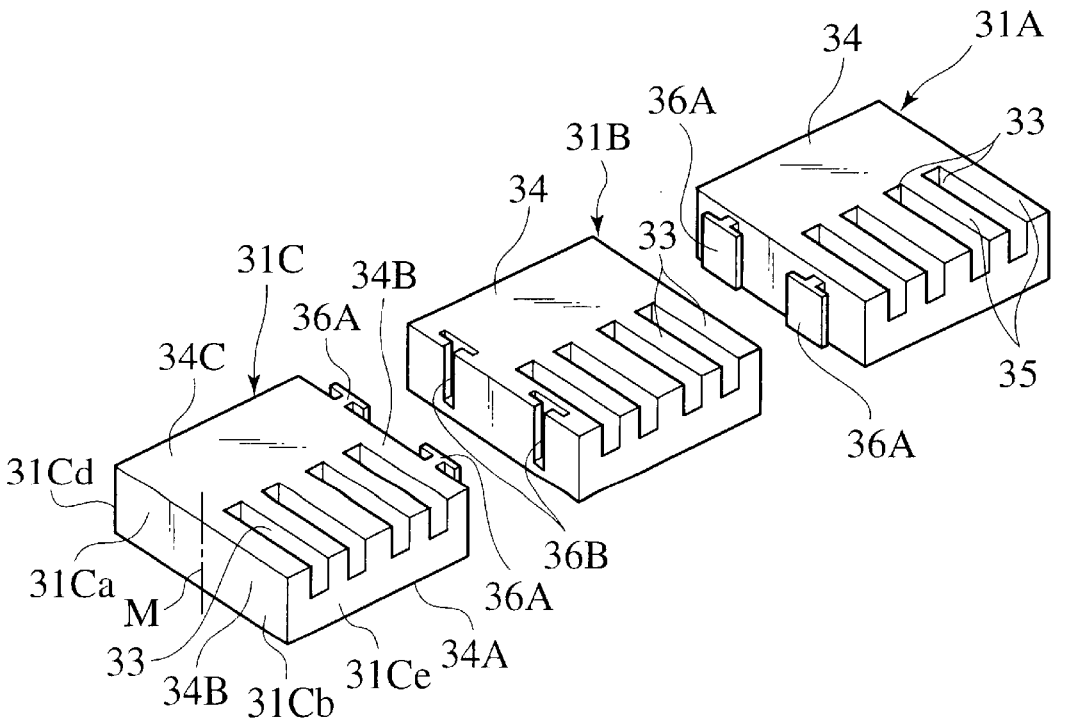
FIG. 11 is a perspective view of inner housings for use in the waterproof connector according to the third embodiment.

FIGS. 9 to 11 show a waterproof connector 30 according to a third embodiment of this invention, which includes three inner housings 31A, 31B and 31C integrated with each other and an outer housing 32 for holding the integrated inner housings 31A, 31B and 31C as shown in FIGS. 9 and 11, and a waterproofing part 37 as shown in FIG. 10.

Each of the housings 31A, 31B and 31C is formed with a plurality of terminal housing channels 33 arranged in parallel, extending longitudinally as shown in FIGS. 9 and 11. In the front portion of each inner housing, the channels extend below a top wall 34C. In the rear portion of the inner housing, a plurality of partitions 35 for separating the channels 33 from each other are formed. An insulation displacement terminal not shown is disposed in each of the channels 33. Each of the housings 31A, 31B and 31C is formed on its side 34B with engagement parts 36A or recesses 36B as engaged parts as appropriate. In order for the housings 31A, 31B and 31C to be integrated with each other, the engagement parts 36A of the housing 31C are inserted into the recesses 36B of the housing 31B, for example. In the same manner, the housing 31A is integrated with the housing 31B.

The outer housing 32 has a width larger than the total width of the integrated housings 31A, 31B and 31C and a thickness larger than the thickness of the housings 31A, 31B and 31C. The outer housing 32 also has an inner housing accommodation space 32A extending longitudinally therethrough. The rear part 32F of the outer housing 32 is formed with a recess 32B to be filled with resin. The recess 32B communicates with the space 32A.

The outer housing 32 is provided at its top with an engagement part 39 to be engaged with a mating connector not shown.

In the waterproof connector 30 of the third embodiment, insulation displacement terminals are fitted into the housings 31A, 31B and 31C. Wires are connected to the terminals 16. Thereafter, the housings 31A, 31B and 31C are integrated with each other and inserted into the space 32A of the outer housing 32. The recess 32B of the outer housing 32 with the housings 31A, 31B and 31C inserted thereinto is injected with hot-melt material to form a waterproofing part 37. As the hot-melt material, thermoplastic polyamide, for example, is used. Appropriate viscosity of the hot-melt material for use ranges from about 2800 to 3800 (mPa/S). Appropriate temperature for the operation ranges from −40° C. to 100° C.

In the third embodiment, the inner housings 31A, 31B and 31C are integrated with each other to be inserted into the outer housing 32. Thus, as shown in FIG. 10, the inner housings 31A, 31B and 31C with their respective terminals connected to their respective different sub wire harnesses Ws are integrated with each other, thereby being able to constitute the single waterproof connector 30. In other words, the use of the waterproof connector 30 of this embodiment eliminates the need for conventional separate operations for connecting three connecters to their respective mating connectors, and allows the connecting operation to be completed at a time.

The entire content of Japanese Patent Application No. 2000-275046, filed on Sep. 11, 2000, is hereby incorporated by reference. While embodiments of the present invention have been described using specific terms, such description is for illustrative purposes, and it is to be understood that changes and variations may be made without departing from the scope of the following claims.

What is claimed is:

1. A waterproof connector comprising:

an inner housing for holding a terminal connected to a wire; and an outer housing having an inner wall defining an accommodating space for the inner housing to be inserted thereinto in the longitudinal direction;

wherein the outer housing with the inner housing inserted thereinto has a rear portion formed with a recess filled with resin for forming a waterproofing part.

2. A waterproof connector comprising:

an inner housing for holding a terminal connected to a wire; and an outer housing having an inner wall defining an accommodating space for the inner housing to be inserted thereinto in the longitudinal direction;

wherein the outer housing, with a plurality of inner housings integrated with each other and inserted thereinto, has a rear portion formed with a waterproofing part made of hot-melt material, the plurality of inner housings each having a terminal connected to a wire of a sub harness branched from a wire harness.

3. A waterproof connector comprising:

an inner housing for holding a terminal connected to a wire; and an outer housing having an inner wall defining an accommodating space for the inner housing to be inserted thereinto in the longitudinal direction;

wherein the outer housing with the inner housing inserted thereinto has a rear portion formed with a waterproofing part made of hot-melt material and the inner housing is formed with a flange contacting a rear end of the inner wall of the outer housing to close the accommodation space.

4. A waterproof connector comprising:

an inner housing for holding a terminal connected to a wire, the inner housing having a rear portion filled with high viscosity gel, the rear portion being where the terminal is disposed and held; and an outer housing having an inner wall defining an accommodating space for the inner housing to be inserted thereinto in the longitudinal direction;

wherein the outer housing with the inner housing inserted thereinto has a rear portion formed with a waterproofing part made of hot-melt material, the waterproofing part being formed on the gel.

* * * * *